US006203932B1

(12) United States Patent
Hisakatu

(10) Patent No.: US 6,203,932 B1
(45) Date of Patent: Mar. 20, 2001

(54) STEEL WIRE FOR REINFORCEMENT OF RUBBER ARTICLES, METHOD OF MANUFACTURING THE SAME, AND STEEL CORD USING THE SAME

(75) Inventor: Hara Hisakatu, Tochigi (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/091,464

(22) PCT Filed: Dec. 20, 1996

(86) PCT No.: PCT/JP96/03715

§ 371 Date: Jun. 17, 1998

§ 102(e) Date: Jun. 17, 1998

(87) PCT Pub. No.: WO97/23311

PCT Pub. Date: Jul. 3, 1997

(30) Foreign Application Priority Data

Dec. 21, 1995 (JP) ..... 7/349035

(51) Int. Cl.[7] ..... B32B 15/18; B32B 15/04; B60C 9/00

(52) U.S. Cl. ..... 428/677; 428/607; 428/632; 428/472.3; 57/902; 152/556

(58) Field of Search ..... 428/625, 677, 428/607, 632, 472.3; 57/902; 152/556

(56) References Cited

U.S. PATENT DOCUMENTS 4,683,175 * 7/1987 Bakewell et al. ..... 428/677
4,952,249 * 8/1990 Dambre ..... 148/11.5 Q
5,014,760 * 5/1991 Bombeke et al. ..... 152/451
5,118,367 * 6/1992 Starinshak ..... 148/262
5,229,215 * 7/1993 Starinshak ..... 428/472.3
5,240,520 * 8/1993 Tarui et al. ..... 148/532
5,437,748 * 8/1995 Bhagwat et al. ..... 148/532

FOREIGN PATENT DOCUMENTS 61-190082 * 8/1986 (JP) .
63-33135 * 2/1988 (JP) .
6-293938 * 10/1994 (JP) .
7-119057 * 9/1995 (JP) .

OTHER PUBLICATIONS

International Search Report for PCT/JP96/03715.

* cited by examiner

*Primary Examiner*—Deborah Jones
*Assistant Examiner*—Stephen Stein
(74) *Attorney, Agent, or Firm*—Sughrue, Mion, Zinn, Macpeak & Seas, PLLC

(57) ABSTRACT

A method of manufacturing steel wire for reinforcement of rubber articles comprises the steps of passing a wire rod plated with brass, through a group of dies immersed in a lubricant containing phosphate in continuous wet processing, winding the resulting steel wire around a spool, mounting the spool on a pay of unit of a twister assembly, and drawing the steel wire by the use of one or more dies arranged between the pay of unit and twisting unit of the twister assembly and having an area reduction per die of at least 5%, to reduce the diameter of the steel wire. Phosphor compound in the coating film formed on the brass plating of the steel wire contains phosphor in the range of 0.2 to 0.9 mg/m$^2$ and zinc oxide in the range of 20.0 to 70.0 mg/m$^2$. Also, provided is a steel cord which comprises twisted steel wires. The initial adhesion of the steel wire or steel cord for reinforcement of rubber articles to rubber is well and economically improved, shortening the curing time and enabling economical production of rubber products.

2 Claims, 3 Drawing Sheets

(CURED UNDER PRESSURE FOR 20 MIN. AT 145° C)

STEEL WIRE FOR REINFORCEMENT OF RUBBER ARTICLES, METHOD OF MANUFACTURING THE SAME, AND STEEL CORD USING THE SAME

BACKGROUND OF THE INVENTION

1. Field of the Invention

The present invention relates to a brass-plated steel wire for reinforcement of rubber articles such as tires, industrial belts and the like, a method of manufacturing the wire, and a steel cord consisting of the wires twisted together, particularly aims to improve initial adhesion of the steel wire to rubber. Here, the initial adhesion means adhesion of steel wire to rubber at the initial stage of vulcanization when manufacturing rubber articles.

2. Related Art

In steel wire or steel cord consisting of wires twisted together used for reinforcement of rubber articles, good adhesion to rubber is required to obtain reinforcing effect. On improvement of the adhesion in steel wire or steel cord with brass-plating, it has been widely known that the adhesion can be more increased by appropriately determining Cz/Zn ratio of the brass plating, thickness of the brass plating and the like.

Moreover, Japanese Patent Application Laid-open No. SHO 62-23977 proposes a method of improving adhesion by applying copper and zinc plating to steel wire, then alloying the copper and zinc to form brass plating by thermal diffusion, and thereafter quenching the brass-plated steel wire with water, thereby controlling production of zinc oxide on the surface of wire.

Further, Japanese Patent Application Laid-open No. SHO 63-33135 proposes to mitigate deterioration of adhesion after steam aging by containing not less than 4 mg/m$^2$ of phosphorous in the brass plating of brass-plated steel wire.

However, in a method comprising quenching with water immediately after thermal diffusion as disclosed in the above Japanese Patent Application Laid-open No. SHO 62-23977, a quenching device is necessary, and also a dryer is necessary for preventing production of rust, so as to require places for setting these devices. As a result, it becomes difficult to produce a steel wire economically.

Moreover, in a steel wire containing phosphorous in the brass plating as disclosed in the above Japanese Patent Application Laid-open No. SHO 63-33135, adhesion to rubber after steam aging is improved, but adhesion at the initial stage of vulcanization is not sufficient to achieve economical production of rubber articles with shortened curing time for energy saving.

Furthermore, in case of manufacturing a cord consisting of steel wires having slightly different diameters, it takes a time to change drawing die schedule in ordinary wet drawing process.

An object of the present invention is to provide economical way to improve initial adhesion of steel wire or steel cord for reinforcement of rubber articles and to materialize shortening of curing time, thereby enabling economical production of rubber articles.

SUMMARY OF THE INVENTION

In order to solve the above problem, the present invention provides a steel wire for reinforcement of rubber articles, which has brass plating consisting of 60–70 wt % of copper and 30–40 wt % of zinc and coating film comprising phosphorous compound and zinc oxide on the surface of the brass plating, wherein amount of the phosphorous compound expressed in amount of phosphorous per unit surface area is within a range of not less than 0.2 mg/m$^2$ and not more than 0.9 mg/m$^2$ and amount of the zinc oxide per unit surface area is within a range of not less than 20.0 mg/m$^2$ and not more than 70.0 mg/m$^2$.

Further, the present invention provides a method of manufacturing the steel wire for reinforcement of rubber articles of the present invention, which comprises the steps of drawing a carbon steel wire rod plated with brass and containing 0.65–0.95 wt % of carbon, through a group of dies immersed in a lubricant containing phosphate in continuous wet drawing, winding the resulting steel wire around a spool, mounting the spool on a pay off unit of a twister assembly to pay off the steel wire, and drawing the steel wire at a drawing unit comprising one or more dies arranged between the pay off unit and a twisting unit in the twister assembly and having an area reduction per die of at least 5%, to reduce the diameter of the steel wire.

In such manufacturing method, application of naphthenic hydrocarbon oil on the steel wire drawn in the continuous wet drawing may be adopted prior to drawing at the drawing unit arranged between the pay off unit and the twisting unit in the twister assembly.

Furthermore, the present invention provides a steel cord for reinforcement of rubber articles, which comprises a plurality of the steel wires of the present invention twisted together.

DESCRIPTION OF THE PREFERRED EMBODIMENTS

Figure 1:
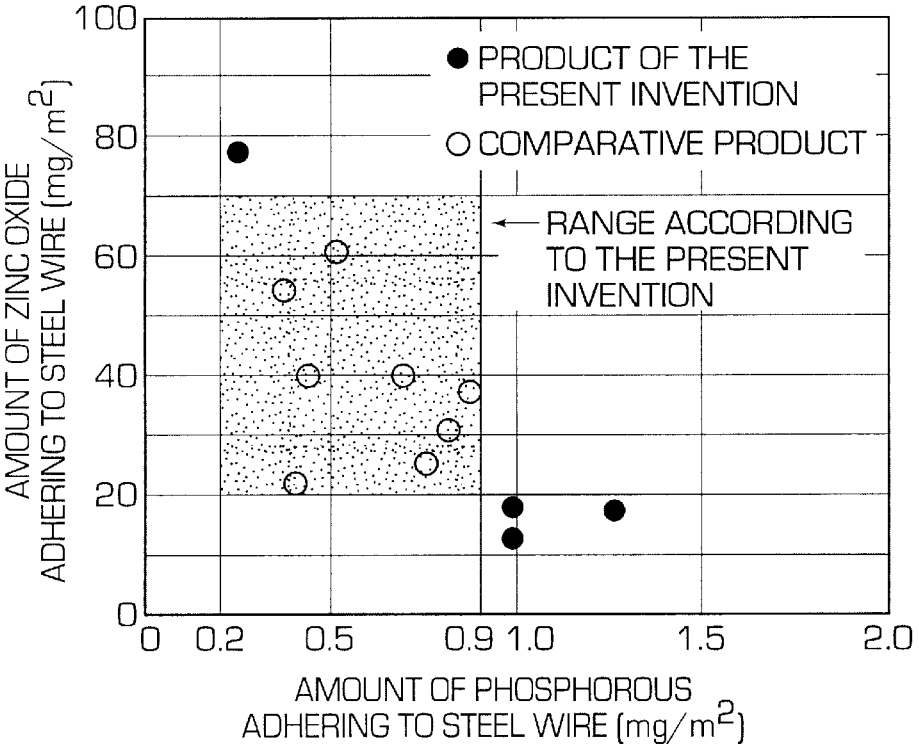
FIG. 1 is a graph showing relationship between amounts of phosphorus and zinc oxide on the surface of steel wire with respect to products of the present invention and comparative products.

The present inventor found that it is effective for improving initial adhesion to reduce an amount of phosphorous compound measured as amount of phosphorous contained in coating film formed on brass plating of steel wire. As a means to reduce such phosphorous, to use a lubricant containing less or no phosphorous compound for wet drawing can be considered, but such a lubricant has poor lubrication and is apt to cause breaking of steel wire as well as rapid wear of dies.

According to the invention, in order to reduce phosphorous in the coating film on the brass plating surface of brass-plated steel wire without such change of lubricant that implies lower drawing speed and lower productivity, a steel wire which has been drawn in continuous wet drawing is drawn again with one or more dies at a drawing speed corresponding to twisting speed which is lower than the drawing speed in the continuous wet drawing. Concretely, a steel wire produced by continuous wet drawing is drawn at a drawing unit having one or more dies arranged between a pay off unit and a twisting unit in a twister assembly. A further advantageous point of this method is that the steel cord manufactured by this method hardly shows rust even if the steel cord is stored in the atmosphere owing to a zinc oxide film formed on the brass plating of steel wire by moderate friction heat generation during reduction of the diameter of the wire with dies at the speed of twisting which is lower than the drawing speed in continuous wet drawing.

There is such an advantage by making an area reduction per die of the drawing dies arranged between the pay off unit and the twisting unit in the twister assembly at least 5% that sufficient heat and pressure can be obtained to shave and remove phosphorous compound remained on the surface of steel wire to be drawn.

Figure 4:
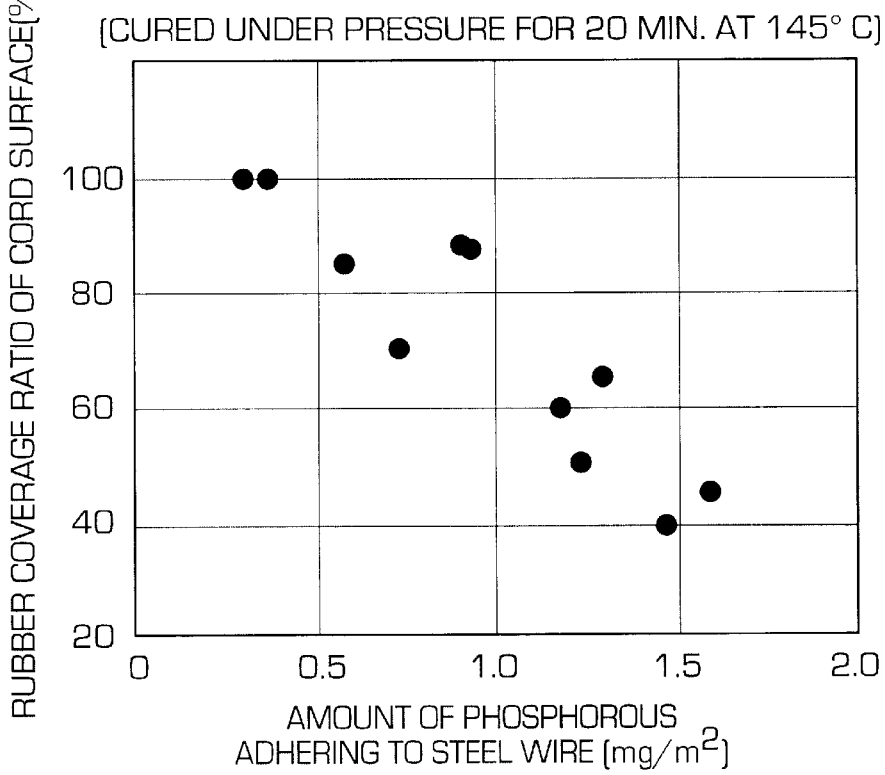
FIG. 4 is a graph showing relationship between amount of phosphorus adhering to steel wire and rubber coverage ratio of cord surface in initial adhesion.

According to the present invention, the initial adhesion is improved by defining amount of phosphorous compound, which can be measured as amount of phosphorous, and amount of zinc oxide in the coating film formed on the surface of brass plating. FIG. 4 shows a result of an observation of rubber coverage ratio in initial adhesion of steel cords having same amount of zinc oxide but varied in amount of phosphorous. As understood from FIG. 4, steel cords having lower amount of phosphorous in the coating film on the brass plating show better results in initial adhesion. However, in case of using a lubricant containing less phosphorous compound for wet drawing to reduce the amount of phosphorous in the coating film to less than 0.2 $mg/m^2$, the drawing ability is deteriorated to thereby increase the breaking of wire. Alternatively, in case of removing too much phosphorous by drawing at the drawing unit arranged between the pay off unit and the twisting unit in the twister assembly, a large burden to the drawing die is required and the life is considerably lowered and the economical production becomes difficult.

On the other hand, at least 20.0 $mg/m^2$ of zinc oxide in the coating film formed on the surface of brass plating is necessary even when the amount of zinc oxide might be reduced, otherwise initial adhesion cannot be improved. Moreover, 70.0 $mg/m^2$ is preferable as an upper limit of zinc oxide amount. Exceeding this value, so much heat generation is necessary that can cause embrittlement of the steel wire.

Usually, brass plating having a composition of Cu/Zn= 60/40–70/30 (wt %) may be applied to the steel wire of the present invention within a range of 1.2–3.8 $g/m^2$.

The drawing operation at the drawing unit arranged between the pay off unit and the twisting unit in the twister assembly may be carried out without a lubricant or with the use of drawing dies immersed in an aqueous lubricant. In the case of using no lubricant, the structure of the drawing unit can be made simple. In the case of using one or more dies immersed in an aqueous lubricant, the structure of the drawing unit turns to be more complicated, but heat generation in drawing can be controlled so as to suppress undesirable denaturalization of brass plating.

In a manufacturing method according to the present invention, when the diameter of steel wire is reduced with the use of drawing dies of the drawing unit in the twister assembly, it is possible to select whether lubricant is used or not according to the speed of twisting. However, in order to reduce friction of each steel wire in twisting, application of oil consisting essentially of naphthenic hydrocarbon to the steel wire may be adopted prior to drawing through drawing die arranged at the drawing unit in the twister assembly. By the application of naphthenic hydrocarbon oil to the steel wire immediately after the continuous wet drawing, rusting of steel wire keeping stored until transferring to twisting process can be suppressed.

As to dies arranged in the atmosphere, diamond dies are advantageous which can shave and remove phosphorous compound more surely and uniformly as compared with cemented carbide dies.

The following Example and Comparative Example are given for the purpose of illustration of the present invention.

COMPARATIVE EXAMPLE

Figure 5:
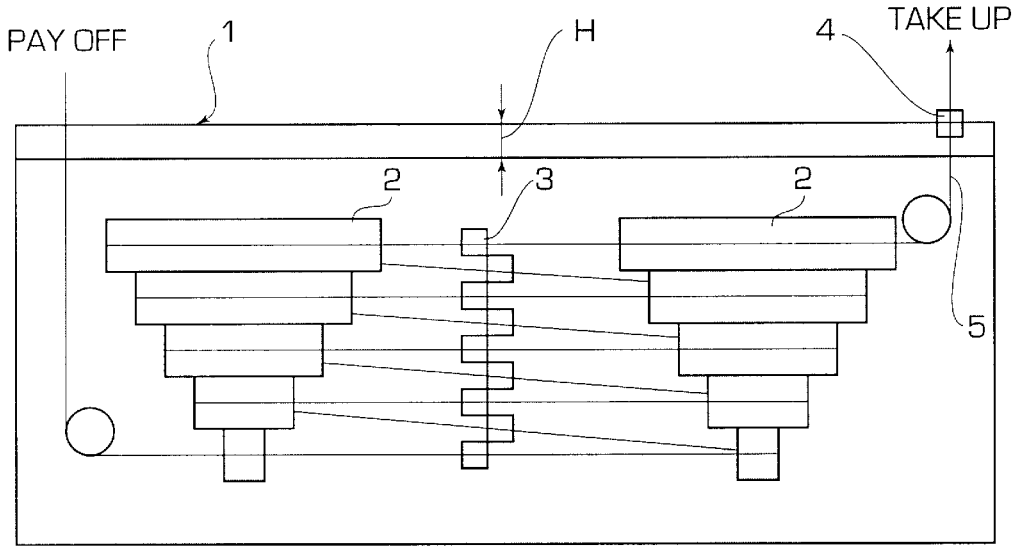
FIG. 5 is a diagrammatic illustration of the continuous wet drawing machine used in the example.

Wire rod for steel cord used for reinforcement of rubber articles, which was 5.5 mm in diameter and contained 0.60–0.90 wt % of carbon, was reduced to 1.40 mm in diameter in dry drawing, thereafter patenting treatment, acid pickling, coating of copper and zinc and then thermal diffusion to form brass plating were carried out to obtain a steel wire rod having a brass plating composition of 63 wt % copper and 37 wt % zinc and a brass plating amount of 15.8 $g/m^2$. Further, there were produced two kinds of steel wires of 0.21 mm and 0.225 mm in diameter with the use of a continuous wet drawing machine totally immersing a group of dies except for first and last dies into an aqueous lubricant containing zinc phosphate, as shown in FIG. 5. These were comparative wires. In FIG. 5, 1 is a lubricant bath, 2 a cone, 3 a group of dies, 4 a final die, 5 a wire rod, and level of the lubricant is variable within a range of H.

EXAMPLE

Figure 6:
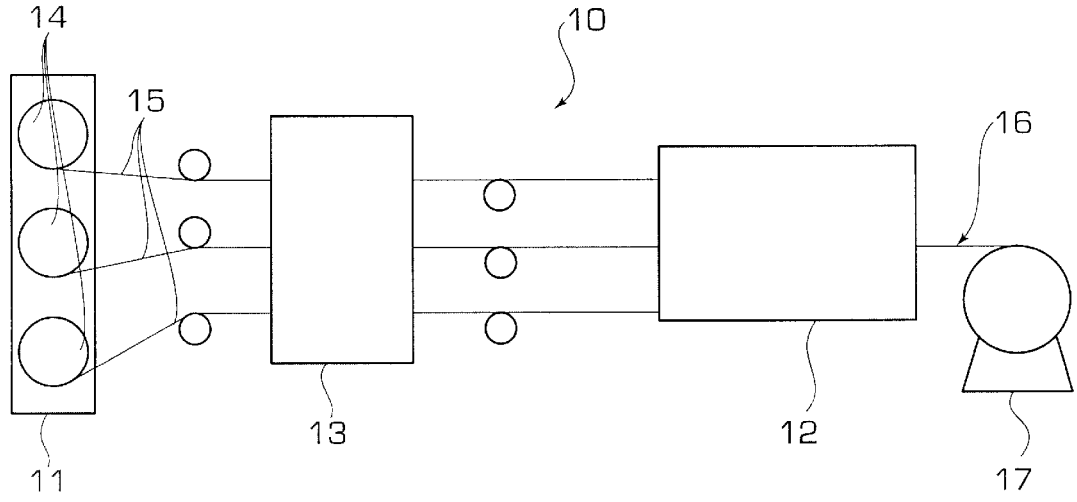
FIG. 6 is a diagrammatic illustration of the twister assembly used in the example.

Diameters of steel wires produced with the use of the continuous wet drawing as described above were made 0.225 mm and 0.24 mm, and then the resulting steel wires 15 were drawn through one drawing die of the drawing unit 13 arranged between the pay off unit 11 and the twisting unit 12 in the twister assembly 10 without using a lubricant, to be thereby reduced into 0.21 mm and 0.225 mm in diameter respectively. These were wires of the present invention. In FIG. 6, 14 is a spool, 16 a steel cord and 17 a take up unit.

Amounts of phosphorus and zinc oxide in the coating film formed on the surface of respective test steel wires were analyzed as follows.

(1) Quantitative analysis of phosphorus and zinc oxide in the coating film formed on the brass plating surface 4 g of sampled steel wire was immersed into 4 ml of a 0.01N hydrochloric acid solution for 10 seconds at room temperature to dissolve a zinc compound on the surface. Here, the zinc compound is assumed to consist of zinc oxide and zinc phosphate. Concentrations of $Zn^{2+}$ and $PO_4^{3-}$ in the thus obtained solution were analyzed by means of an inductively coupled plasma spectrometry, and amounts of phosphorous and zinc oxide per unit surface area of the steel wire were calculated. The results are shown in FIG. 1.

As understood from FIG. 1, in each product of the manufacturing method according to the present invention, the amount of phosphorus on the surface of the steel wire is within a range of 0.2–0.9 $mg/m^2$, and the amount of zinc oxide is within a range of 20–70 $mg/m^2$. Moreover, scattering of results in FIG. 1 for both invention and comparative products is caused by that the products of the invention include products with or without application of oil drawn with diamond dies or cemented carbide dies in a lubricant at the drawing unit in the twister assembly and that the comparative products partly include products drawn in different lubricant or different drafting schedule.

Among the wires analyzed above, wires having a diameter of 0.225 mm produced by drawing with continuous wet drawing machine alone were used for comparative steel cords, and wires produced by drawing into 0.24 mm in continuous wet drawing and then into 0.225 mm in drawing without lubricant were used for steel cords of the invention. Several kinds of steel cords were made, each having the same kind of five steel wires twisted together. These steel cords were covered with rubber compound, cured, and then subjected to an initial adhesion test. Here, the rubber compound consists of 50 parts by weight of carbon black, 5 parts by weight of zinc oxide, 2 parts by weight of stearic acid, 1 part by weight of antioxidant, 2 parts by weight of cobalt naphthenate, 1.5 parts by weight of vulcanization accelerator and 4 parts by weight of sulphur based on 100 parts by weight of natural rubber.

Initial adhesion was evaluated by pealing test at room temperature after curing the rubber-coated cords for 20 minutes at 145° C. under pressure. Strength of adhesion was measured as a force necessary to peal the cord from rubber. Rubber coverage ratio was evaluated by observation of the steel cord after pealing wherein 100% meant that the surface of the steel cord was completely covered with rubber and 0% meant that the steel cord was not covered at all.

Figure 2:
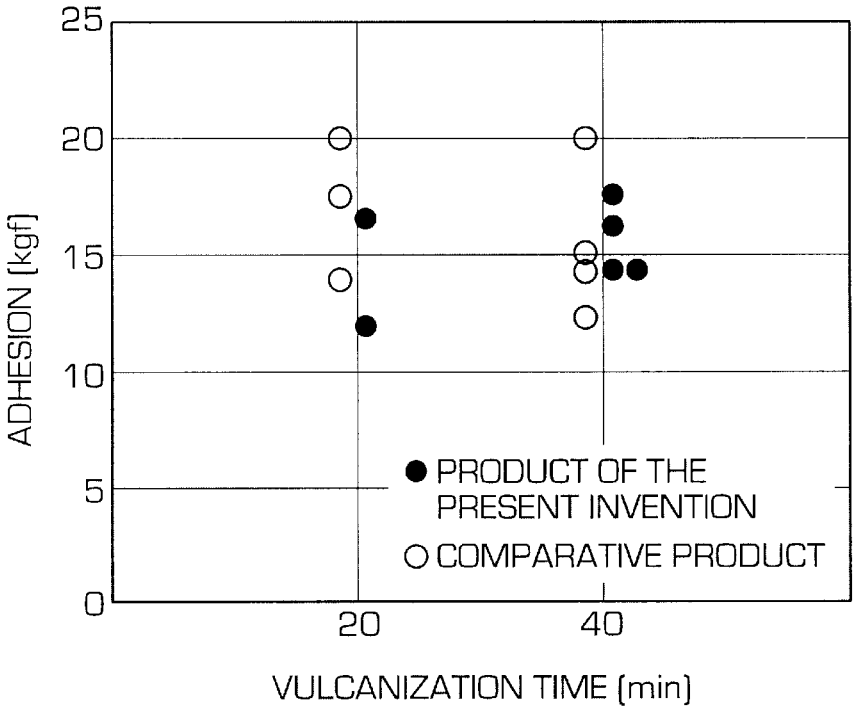
FIG. 2 is a graph showing relationship between vulcanization time and adhesion of steel cord with respect to products of the present invention and comparative products.
Figure 3:
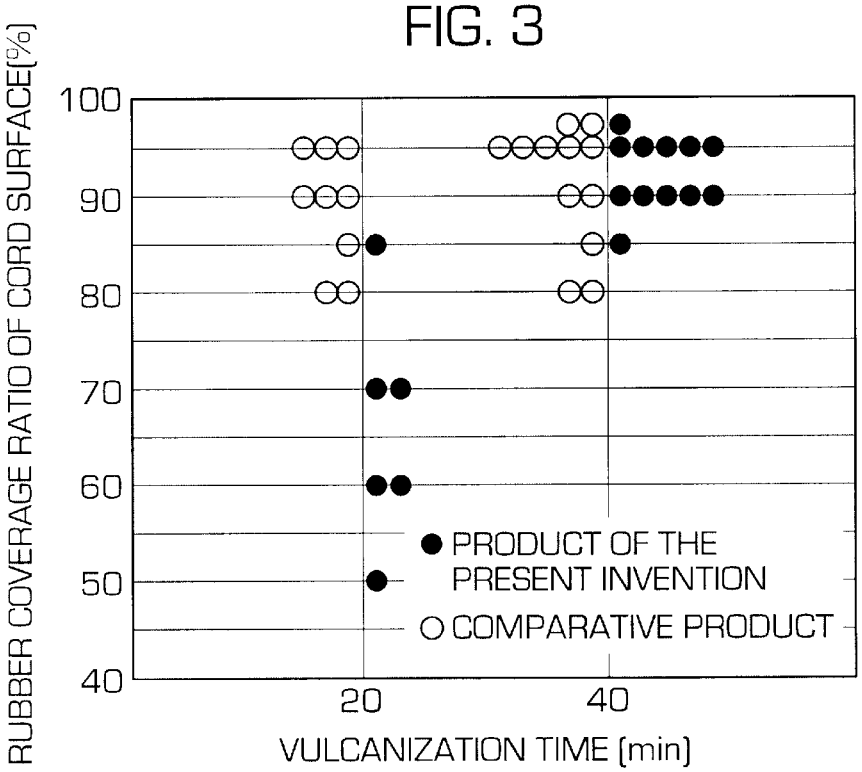
FIG. 3 is a graph showing relationship between vulcanization time and rubber coverage ratio of cord surface with respect to products of the present invention and comparative products.

These results are shown in FIGS. 2 and 3, respectively. As understood from these figures, wires of the invention produced by methods according to the invention showed considerably higher rubber coverage ratio than comparative wires, while they showed moderate improvement in strength of initial adhesion. In the adhesion test, three cords were pealed together from rubber measuring pealing force, and then rubber coverage ratio was observed for each of the three cords. Therefore, the number of plots of rubber coverage ratio is three times larger than that of adhesion.

INDUSTRIAL FEASIBILITY

The steel wire and steel cord for reinforcement of rubber articles of the present invention are excellent in initial adhesion to rubber, thereby enabling to shorten vulcanization time and to produce rubber articles economically.

According to the method of the present invention, control of amount of zinc phosphate for maintaining or improving lubrication in wet drawing can be done regardless of its effect on initial adhesion, so as to improve drawing productivity. Moreover, the method's ability for controlling the amount of zinc oxide formed on the surface of brass plating can be advantageous to improvement of aging property of adhesion. Furthermore, the method of the present invention is also advantageous to manufacture of many kinds of products in limited volume. For example, in case of manufacturing steel cord comprising steel wires having slightly different diameters, steel wires of desired diameters are obtained by drawing with dies of the drawing unit arranged between the pay off unit and the twisting unit in the twister assembly from steel wires of a common diameter which have been produced by continuous wet drawing in large volume. Moreover, in case of application of oil to reduce friction between steel wires in twisting, prior art has implied a difficulty in controlling the amount of applied oil to a minimum and sufficient value, but the method of the invention can overcome such a difficulty.

What is claimed is:

1. A steel wire for reinforcement of rubber articles which has brass plating comprising 60–70 wt % of copper and 30–40 wt % of zinc and coating film comprising phosphorous compound and zinc oxide on the surface of the brass plating, wherein the amount of the phosphorous compound expressed in the amount of phosphorous per unit surface area is within a range of not less than 0.2 $mg/m^2$ and not more than 0.9 $mg/m^2$ and the amount of the zinc oxide per unit surface area is within a range of not less than 20.0 $mg/m^2$ and not more than 70.0 $mg/m^2$.

2. A steel cord for reinforcement of rubber articles, which consists of the steel wires of claim 1 twisted together.

* * * * *